US008357245B2

(12) United States Patent
Crocker

(10) Patent No.: US 8,357,245 B2
(45) **Date of Patent: *Jan. 22, 2013**

(54) STRIPE REMOVAL SYSTEM

(76) Inventor: James P. Crocker, Stuart, FL (US)

( * ) Notice: Subject to any disclaimer, the term of this patent is extended or adjusted under 35 U.S.C. 154(b) by 385 days.

This patent is subject to a terminal disclaimer.

(21) Appl. No.: 11/835,642

(22) Filed: Aug. 8, 2007

(65) Prior Publication Data

US 2008/0066781 A1 Mar. 20, 2008

Related U.S. Application Data

(63) Continuation of application No. 10/884,643, filed on Jul. 2, 2004, now Pat. No. 7,255,116.

(51) Int. Cl.
*B08B 3/02* (2006.01)

(52) U.S. Cl. ..... 134/21; 134/10; 134/18; 134/34; 134/37; 15/347

(58) Field of Classification Search ..... 134/10, 134/21, 34, 37; 15/320, 339, 347
See application file for complete search history.

(56) References Cited

U.S. PATENT DOCUMENTS

| | | | | |
|---|---|---|---|---|
| 2,074,623 | A | | 3/1937 | Schroth |
| 3,151,348 | A | | 10/1964 | Maasberg |
| 3,166,773 | A | | 1/1965 | Wyczalek |
| 3,532,070 | A | | 10/1970 | Lamarque |
| 3,540,073 | A | | 11/1970 | Issenmann et al. |
| 3,639,936 | A | | 2/1972 | Ashton |
| 3,787,916 | A | | 1/1974 | Akagi et al. |
| 3,900,969 | A | | 8/1975 | Diehn |
| 3,959,010 | A | | 5/1976 | Thompson et al. |
| 3,977,128 | A | | 8/1976 | Goff |
| 4,007,026 | A | | 2/1977 | Groh |
| 4,158,575 | A | | 6/1979 | Townsend |
| 4,290,820 | A | | 9/1981 | Swisher, Jr. et al. |
| 4,336,671 | A | | 6/1982 | Nelson |
| 4,376,358 | A | | 3/1983 | Shelton |
| 4,377,924 | A | | 3/1983 | Bergh |
| 4,753,052 | A | | 6/1988 | Dickson |
| 4,801,376 | A | * | 1/1989 | Kulitz ..... 210/123 |
| 4,819,676 | A | | 4/1989 | Blehert et al. |
| 4,839,061 | A | | 6/1989 | Manchak Jr. et al. |
| 5,076,919 | A | | 12/1991 | Francisco, Jr. |
| 5,224,236 | A | | 7/1993 | Sallquist |
| 5,236,278 | A | | 8/1993 | Dickson |
| H1660 | H | | 7/1997 | Herman et al. |
| 5,704,989 | A | | 1/1998 | Page |
| 6,042,656 | A | * | 3/2000 | Knutson ..... 134/21 |
| 6,129,094 | A | | 10/2000 | Moll et al. |
| 6,302,967 | B1 | * | 10/2001 | Rohrbacher et al. ..... 134/10 |
| 6,896,742 | B2 | | 5/2005 | Geyer et al. |
| 2003/0205242 | A1 | | 11/2003 | Gerber et al. |
| 2004/0237247 | A1 | | 12/2004 | Nowak et al. |

* cited by examiner

*Primary Examiner* — Saeed T Chaudhry
(74) *Attorney, Agent, or Firm* — McHale & Slavin, P.A.

(57) ABSTRACT

A system for removing paint and other coatings from hard surfaces is mounted on a truck for over-the-road travel. The truck bed carries a high power vacuum pump, a self propelled tractor with an attached blast head, a liquid reservoir, a sump or vacuum tank, and a ramp for loading the tractor. The reservoir is connected to a low pressure pump that transfers water to the high pressure pump. The high pressure pump is connected to the blast head by a high pressure hose. A vacuum hose is connected to the sump which has an internal enclosure for separating the waste materials from the liquid for easy dumping of semi dried materials.

6 Claims, 6 Drawing Sheets

STRIPE REMOVAL SYSTEM

CROSS REFERENCE TO RELATED APPLICATIONS

This application is a continuation of U.S. patent application Ser. No. 10/884,643, filed Jul. 2, 2004 now U.S. Pat. No. 7,255,116, the contents of which is herein incorporated by reference.

FIELD OF THE INVENTION

This invention relates to the field of high pressure water cleaning devices for highways, runways, parking decks, and other hard surfaces.

PRIOR ART BACKGROUND

The use of paint stripes on road surfaces is the accepted method to indicate vehicle lanes, crossing lanes, parking areas and numerous other indicators. Various pavement marking techniques are known, including the use of traffic paint, thermoplastic, epoxy paint and preformed tapes. Common pavement surfaces are asphalt and concrete. Most pavement marking systems are intended to be as durable and permanent as possible, and resistant to weathering and wear from traffic.

The removal of such striping is typically required when the road is to be resurfaced or if the indication is to be changed. The removal of such stripes is typically performed by use of abrasive wheels, grinding teeth, or the blasting of abrasive particles against the material to be removed. The use of these carbide teeth and grinding wheels results in an undesirable trench or groove in the road.

For example, paint, when used for roadway marking, penetrates into the pavement, perhaps ⅛-⅜ inch, so that mere surface removal of the paint is not sufficient to remove the marking. For example, a pavement marking removal technique that uses abrasive wheels or teeth can create excessive heat which may be suitable for removing painted markings but can melt thermoplastic materials causing equipment to gum up, by reconstituting the thermoplastic.

Current pavement marking removal machines typically employ various forms of cutting devices to remove the marking material, as well as a portion of the underlying layer of pavement material, for example, ⅛-⅜ inch, in order to effectively remove painted lines, including paint which has penetrated the porous pavement. A common type of machine employed for removing pavement marking is known as a "Road Pro" grinder manufactured by Dickson Industries, Inc., in Dickson U.S. Pat. No. 5,236,278. This type of machine employs parallel passive shafts that extend between circular rotating end plates. Hardened steel star wheels are carried on the parallel passive shafts, and these star wheels strike and abrade the pavement surface.

Another approach to pavement marking removal is the use of diamond saw blades arranged to make a dado cut. Still other types of machines use grinders or shot blast as described in Patent Registrations U.S. Pat. Nos. 4,753,052; 4,376,358; 3,900,969; 4,336,671; 3,977,128 and 4,377,924.

NLB Corporation markets a high pressure water jet system for removing paint from pavement under the name "StarJet". The water jet system includes a blast head frame mounted on an attachment to the front bumper of a prime-mover truck. Casters support the frame for movement over the pavement and the path of the blast head is controlled by the driver steering the truck. Because of the position of the driver and the cab body of the prime-mover, it is difficult to see the blast head's position with regard to the stripes on the pavement. Any vision at all requires the driver to lean out of the driver's side window resulting in fatigue and other non ergonomically efficient factors. Positioning the head to the passenger side is performed manually with some difficulty and greatly complicating the driver's ability to view the blast path. The driver must now position himself in an almost upright standing position. Further, due to the length of the extension holding the blast head, the angular off-set, and the swivel of the casters, the movement of the wheel of the truck is not directly related to the path of the blast head.

NLB Corporation also has another system marketed under the mark "StripeJet", that is a self propelled tractor with a blast head on the front of the tractor. The blast head has a shroud and high pressure inlet with a vacuum recovery.

Another stripe removal system is marketed by the Blasters Corporation which is mounted on a truck similar to the "Star-Jet" device. Another model appears to be a self-powered four wheeled tractor, similar to a grass mower, which supports a driver and is connected to the prime-mover by high pressure lines for delivery of high pressure water to a blast head. The blast head is on the front of the tractor.

The problem with the prior art is the inability to place an operator close to the material removal site by use of a device that has over-all dimensions that allow for easy transfer sideways on a truck or trailer having a width less than 8'6".

SUMMARY OF THE PRESENT INVENTION

Briefly, disclosed is a cleaning system for removing coatings from a hard surface by high pressure liquid. The system employs a liquid reservoir connected to a high pressure pump for directing ultra high pressure water through a blast head mounted on a self-propelled mobile frame. The mobile frame is a self-propelled tractor wherein the blast head and tractor are of a size for removably docking transversely on a bed of said truck. The cleaning system is mounted on the truck or pulled behind the truck on a trailer. The truck is then tethered to the tractor during operation. The truck bed includes a ramp sized to support the tractor for docking and transport.

It is an object of this invention to provide a vacuum recovery truck mounted stripe removal system having a compact unit for safe, fast over-the-road travel to job sites.

It is another object of this invention to provide a unit that is quickly deployed, with hoses not having to be disconnected, and in operation at the job site.

It is a further object of this invention to provide a tractor mounted blast head that is hydraulically articulated from left to right and at the same time when moved all the way to the right this also brings the blast head closer to the wheels of the tractor thereby reducing its overall dimension to under 8'6" when in its upright and locked position to reduce the over-all dimensions of the blast head for over-the-road transportation.

It is still another object of this invention to provide a blast head that is articulated to swing horizontally independently of the tractor path for more flexibility in coverage.

It is a further object of this invention to provide a high pressure water jet for removal of paint or other coverings and a vacuum recovery system for the water and debris being generated.

It is yet another object of this invention to provide a collection/filter receptacle for the removed materials for ease of disposal and the release of filtered wastewater. This allows an operator to easily regain all of the available capacity not occupied by paint chips or road debris of the vacuum chamber by simply releasing the dump valve. All of the remaining debris is retained until such time as the vacuum chamber is completely full of actual debris. The amount of capacity able to be regained will be continually diminished as the vacuum tank fills with debris and will eventually reach a point of inefficiency at which point it must be dumped. When the material is dumped, it is dumping semi dried, dewatered debris in which the wastewater is not mixed with the debris.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION OF THE INVENTION

Figure 1:
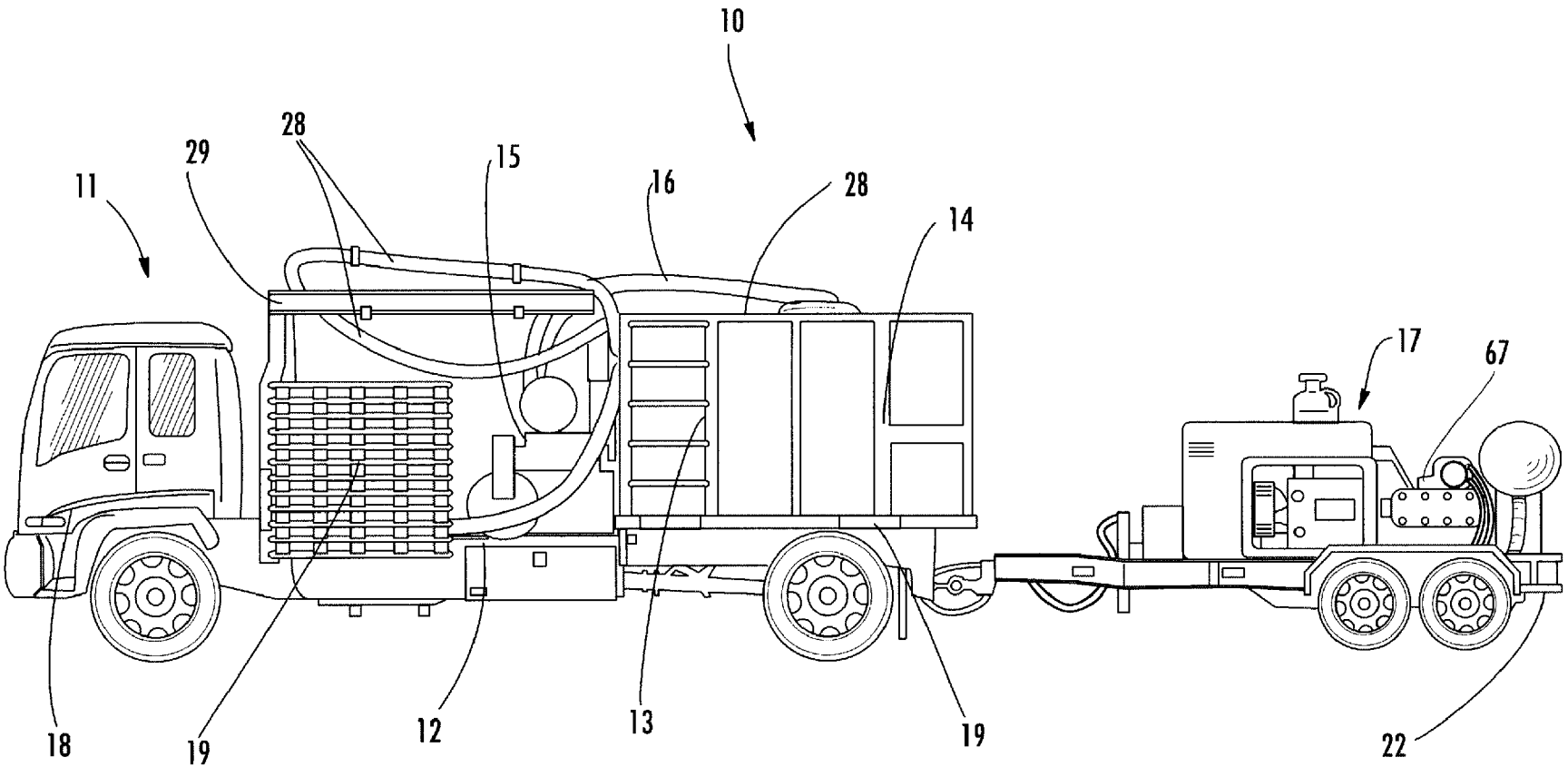
FIG. 1 is a side view of the stripe removal system.

The paint removal system 10, shown in FIG. 1, includes a prime-mover truck 11 and a trailer 17. The truck has a forward cab-over 18 for the driving controls and operator. Mounted on the bed 12 of the truck is the water reservoir 13 and the sump 14 or vacuum chamber. The reservoir and sump are interconnected by a strategically positioned duct for continuous dumping of filtered wastewater when operating from a fixed position where liquid is supplied to the high pressure pump by a means other than the reservoir 13.

The sump 14 is positioned on the rear end of the bed 12. The rear portion 19 of the bed is pivotally mounted on the truck frame and hydraulicly powered to move in the vertical plane permitting dumping of the contents of the sump 14. The sump 14 is connected to the vacuum pump 15 by hose 16. The intake of a high power vacuum pump capable of approximately 1100 CFM (cubic feet per minute) is connected to the vacuum tank. The vacuum tank and pump are also mounted on the bed of the prime-mover 11.

A ramp 19 is hinged to the edge of the bed 12 between the vacuum pump 15 and the cab 16. The ramp can be lowered to provide a pathway for the self propelled tractor 20. As shown, the ramp 19 is in the stowed or traveling position for highway transport. When the ramp is unfolded it is approximately 9 feet in length.

The trailer 17 is removably attached to the prime-mover through a conventional trailer hitch 21. Mounted on the bed 22 of the trailer is a high pressure fluid pump greater than 25,000-40,000 psi and from 2-15 gallons per minute. A high pressure hose connects the pump with the blast head during operations.

Figure 2:
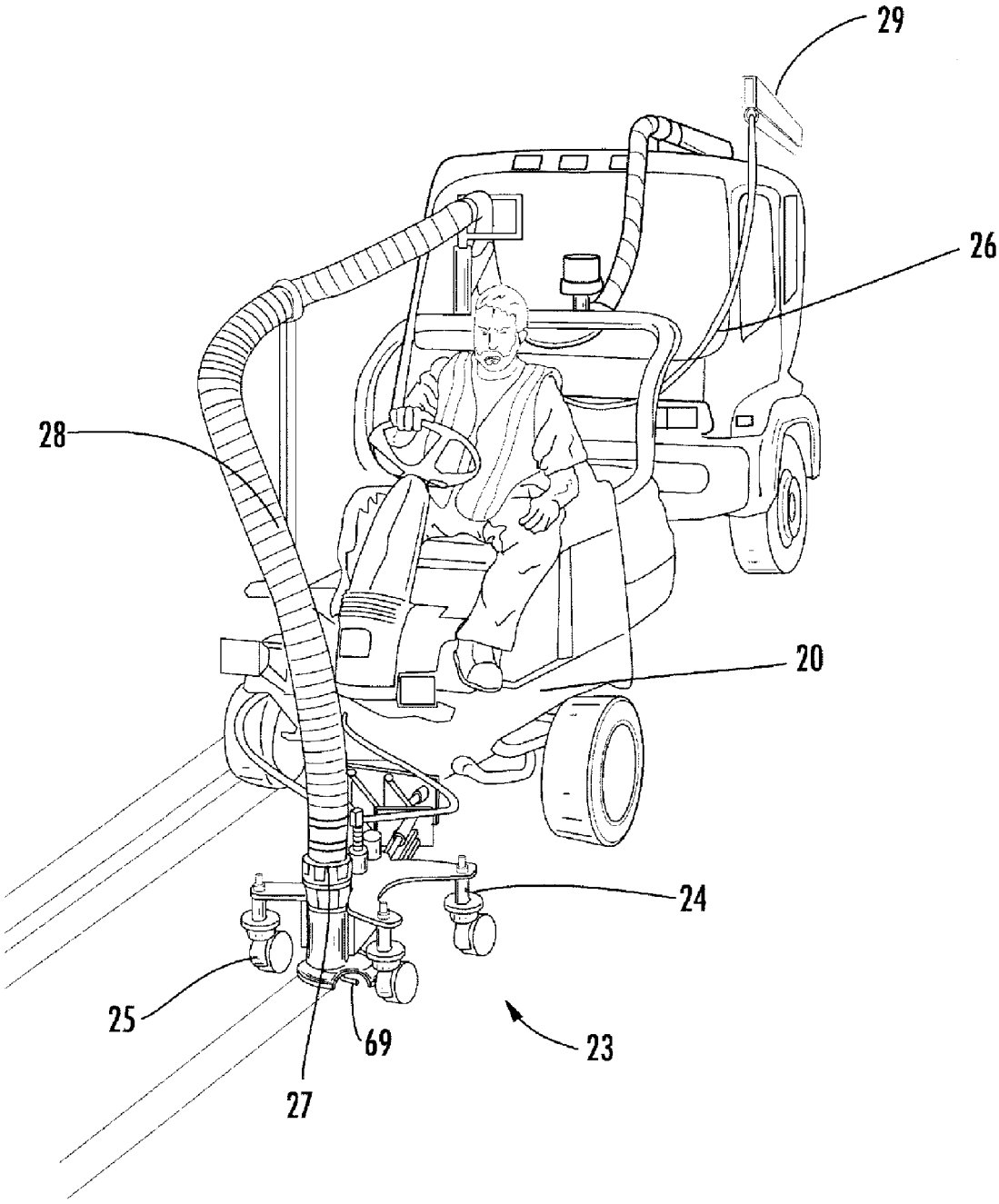
FIG. 2 is a perspective of the stripe removal system with blast head deployed.

In FIG. 2 the mobile tractor 20 is illustrated in the normal operations position. The tractor is similar to a riding mower with a small engine self propelling the tractor. The blast head 23 has at least one and up to sixteen high pressure nozzles 69 delivering high pressure fluid to the surface to be cleaned.

The high pressure nozzle is carried on a chassis 24 mounted on casters 25. A shroud 27 descends from the chassis and surrounds the high pressure nozzle. The blast head is connected to the high pressure hose by line 26 and the shroud 27 is connected to the sump by waste removal hose 28. The high pressure hose 26 and the vacuum hose 28 is supported by a swinging boom 29 which is mounted on the prime mower 11 shown in FIG. 1 to provide freedom of movement for the tractor and to prevent tangling or running over of the hoses by the prime mover.

Figure 3:
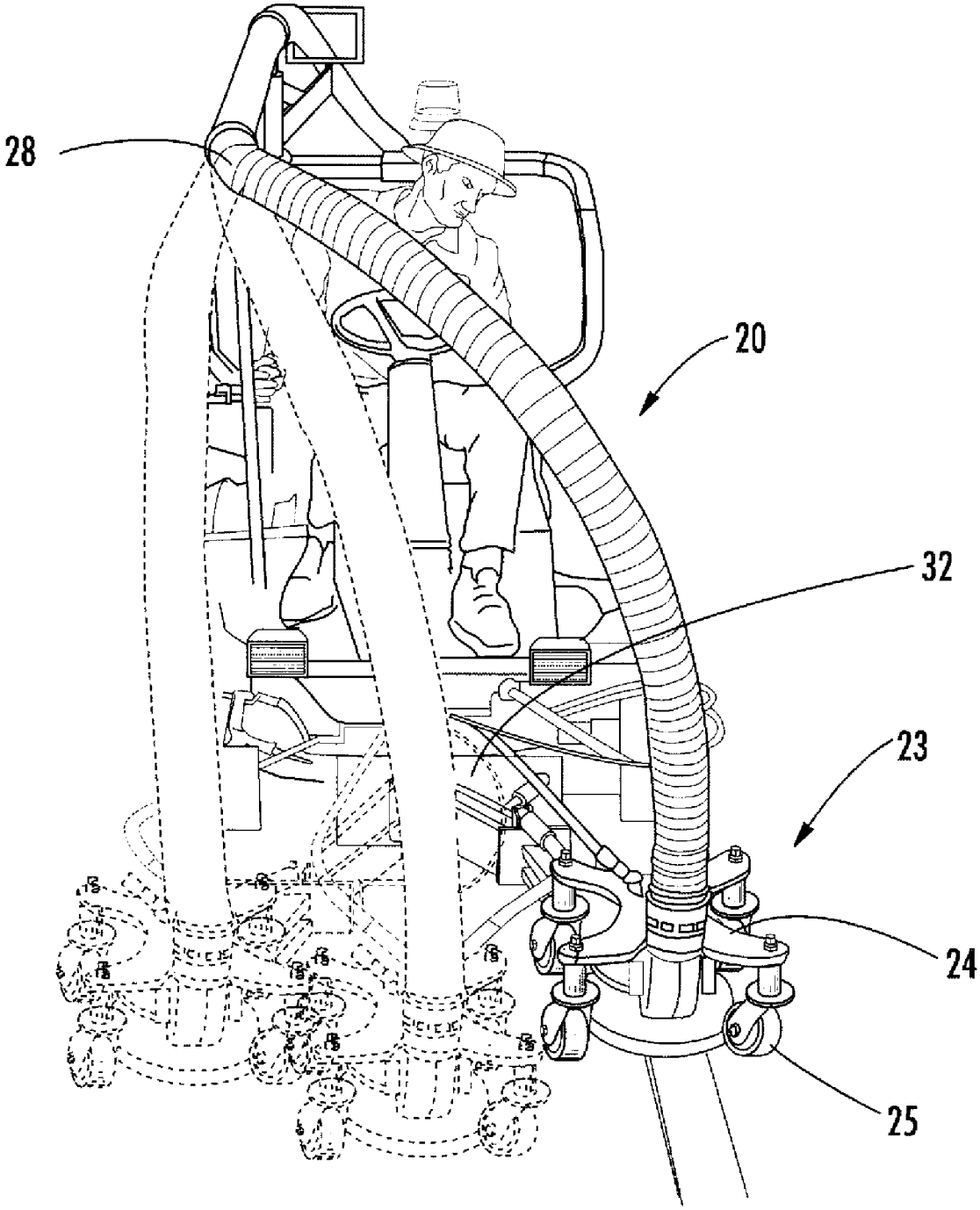
FIG. 3 is a front view of the blast head and tractor.
Figure 4:
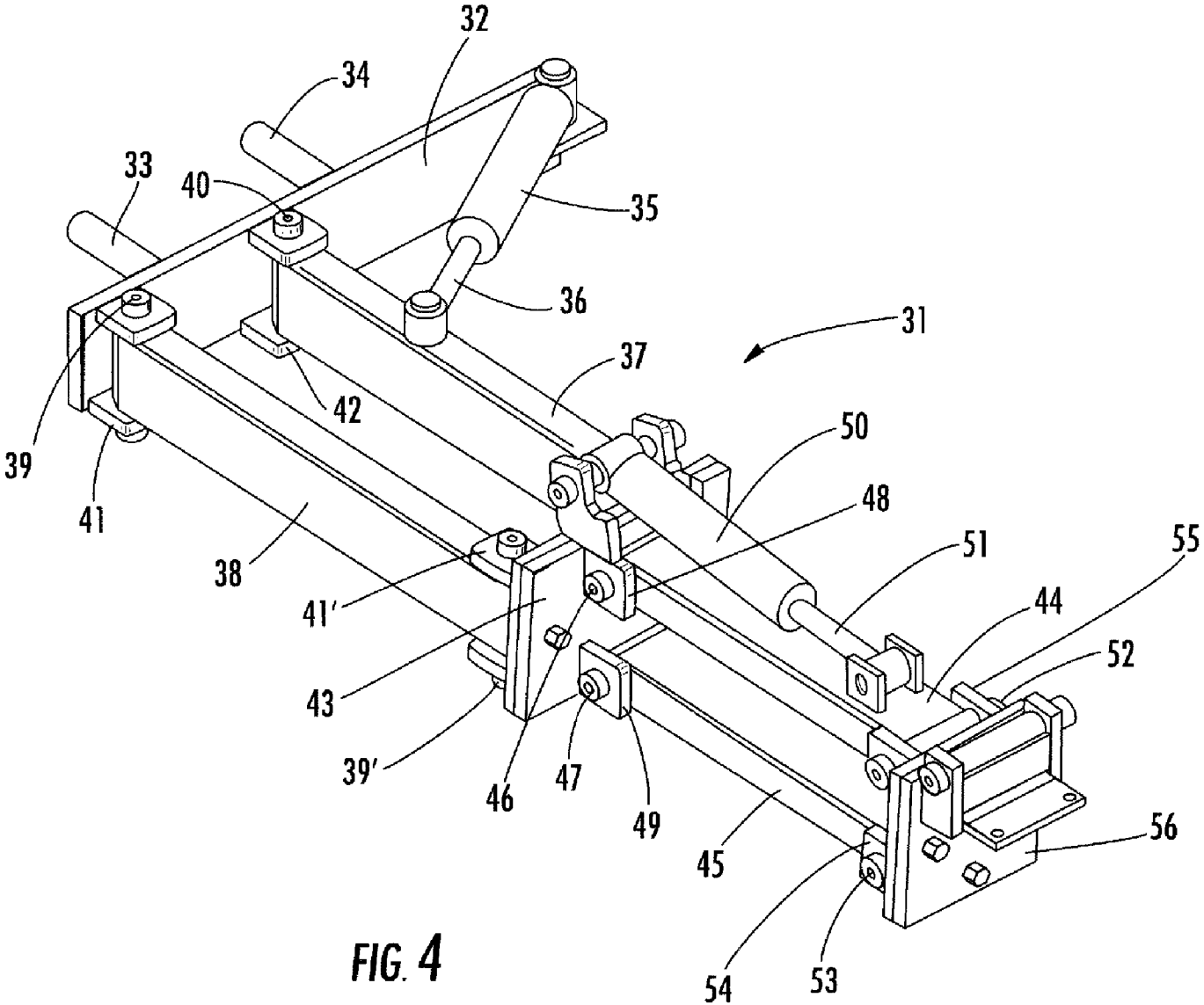
FIG. 4 is perspective of the blast head link.
Figure 5:
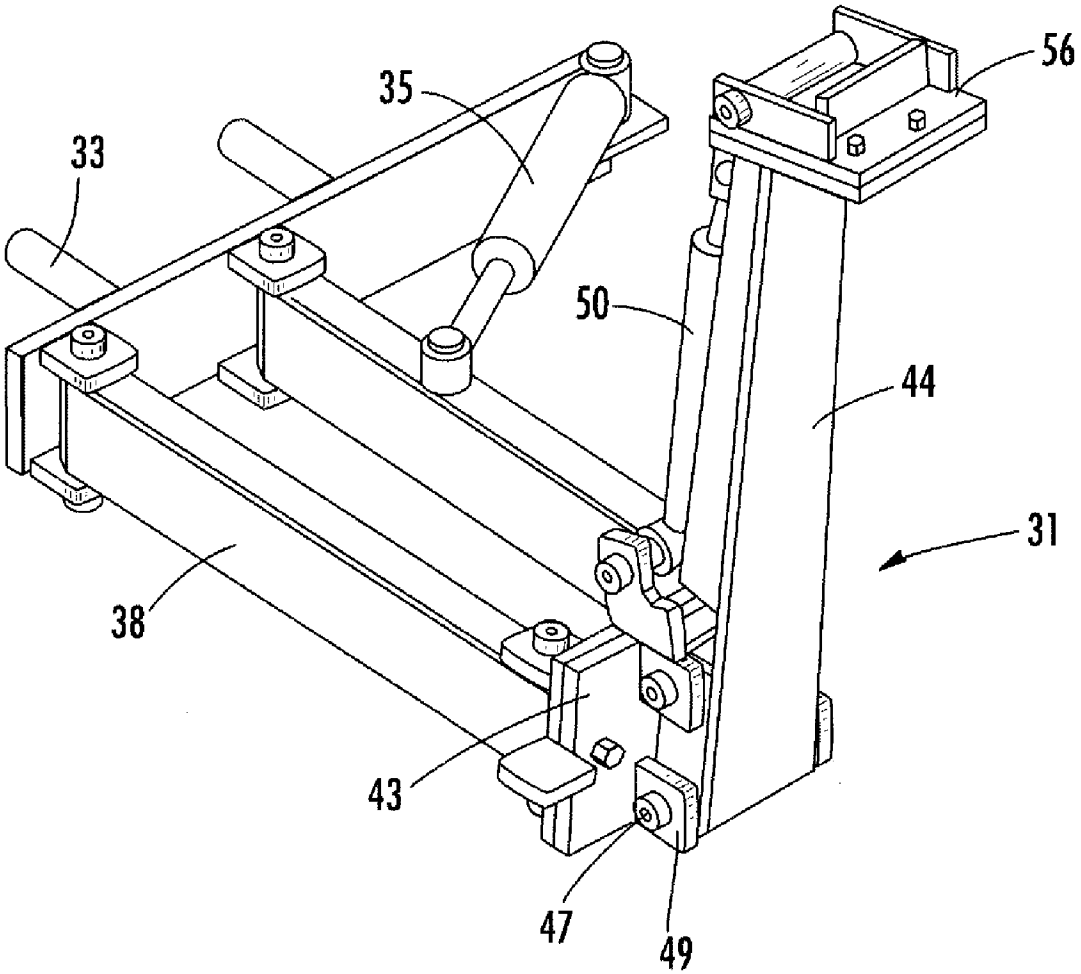
FIG. 5 is a side view of the tractor with blast head stowed.

As shown in FIGS. 3-5, the blast head 23 is connected to the tractor 20 by an articulated link 31 which is capable of horizontal movement, as shown in FIGS. 3 and 4, and vertical movement, as shown in FIG. 5. A bar 32 is attached to the tractor frame by rods 33 and 34. The bar 32 is located between the front wheels of the tractor. The horizontal swinging movement of the link results in a widened path of the high pressure nozzle to adjust for different widths or patterns of striping of the surface being cleaned and deviations in direction of the tractor. The horizontal movement is powered by the hydraulic cylinder 35 connected to bar 32 which may be controlled by the operator moving a joy stick on the tractor. As the hydraulic piston 36, connected to the trailing arm 37, arm 37 and 38 move, with the trailing arms rotating about pins 39 and 40 attached by brackets 41 and 42 on bar 32.

The forward end of the articulated link 31 has a plate 43 connected to the forward ends of trailing arms 37 and 38. The arms 37 and 38 are rotatably connected to the plate by brackets 41' holding pins 39', respectively. The forward arms 44 and 45 are rotatably connected to the plate 43 to rotate vertically. Pins 46 and 47 extend horizontally through brackets 48 and 49. Another hydraulic cylinder 50 is connected to the plate 43 and the piston 51 is connected to the forward end of the arm 44. As the piston 51 moves, the distance between the surface to be cleaned and the blast head 23 changes. The vertical movement permits elevation changes to accommodate the contours of the surface. Further, the blast head 23 may be raised to the vertical position and then manually flipped up and back reducing the overall length to permit the tractor 20 and blast head 23 to be stowed on a truck bed sideways consuming a space of less than 8'6" for highway travel, shown in FIG. 5. The forward ends of the arms 44 and 45 are attached by pins 52 and 53 to brackets 54 and 55 to prevent binding as the arms are manipulated. The brackets are mounted on blast head attachment plate 56.

A blast head attachment plate 56 is removably connected to the chassis 24 of the blast head 23 to provide support and control of the blast head from the tractor through the link 31.

Figure 6:
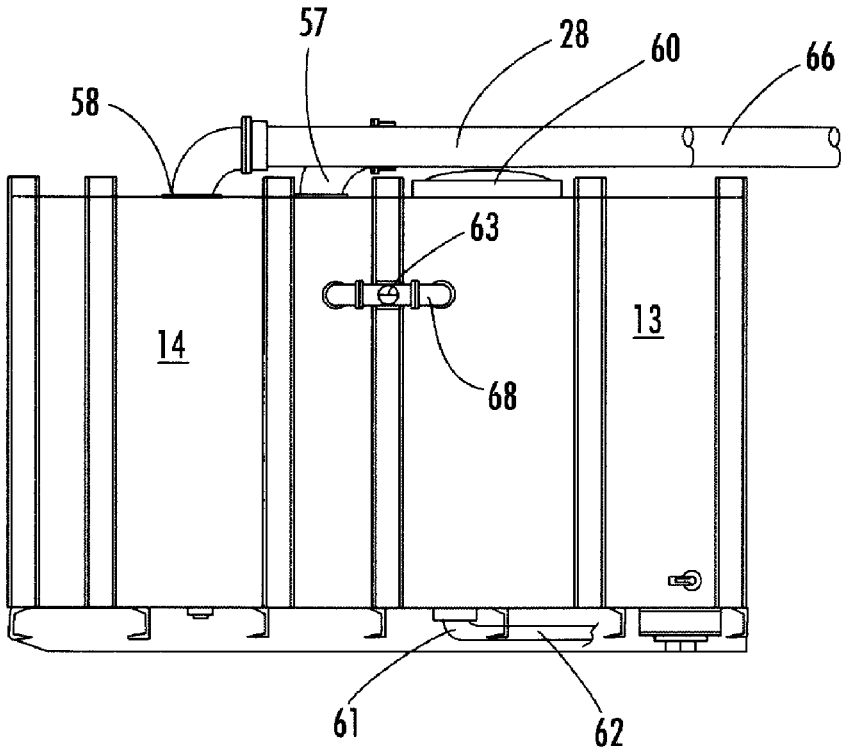
FIG. 6 is a side view of the liquid reservoir and sump.

The liquid reservoir 13 and the sump 14 are shown in FIG. 6. As illustrated, the liquid reservoir and vacuum chamber have a common enclosure with an internal partition dividing them. The sump 14 has an inlet 57 for connection by hose 28 to the vacuum shroud 27. An outlet 58 is connected to the vacuum pump hose 16. The liquid reservoir has a hatch 60 for inspecting and cleaning the reservoir with approximately 600-1500 gallons of liquid. An outlet 61 is connected to a low pressure pump by a low pressure suction hose 62. The low pressure 12 volt pump is used to pump water out of the reservoir 13 back to the water blasting pump 67 at about 40 Psi and 20 g.p.m. A recycling valve 63 is mounted in a connector pipe 68 having one end opening into the reservoir 13 and the other end opening into the sump 14. The connector is located near the top of the sump and reservoir to allow for some settling of debris in the sump. The valve 63 opens or closes the connection.

Figure 7:
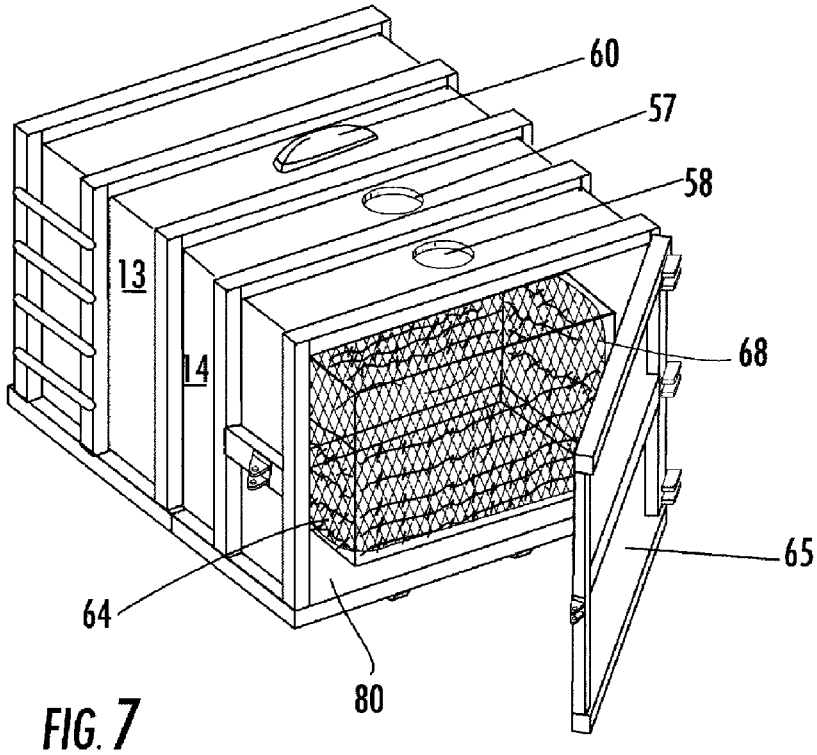
FIG. 7 is a perspective of the sump and waste removal system.

In FIG. 7, the sump 14 is shown with the rear door 65 open for unloading the porous enclosure 64. The door has a seal (not shown) to maintain the negative pressure therein during operation. The porous enclosure may be a wire screen or mesh box sized to fit within the sump 14. An additional filter bag 68 having between 5-200 micron porosity may be inserted into the enclosure. The dimensions of the enclosure 64 are somewhat less than the interior of the sump which provides a marginal area 67 between the enclosure and the interior walls and floor of the sump which provides an exit path for filtered water through valve 70. The inlet 57 empties into the enclosure 64 thereby preventing coatings from being entrained in the vacuum system. One side of the enclosure is hinged and latched to permit entry into the enclosure or removal of the filter bags. By opening the sump door and raising the dump bed of the truck, the waste material can be easily and quickly removed without prolonged interruption of the operations. The filter bag is the disposal container, and is dumped with the material. A permanent filter material can also be utilized which requires cleaning after each use but does not waste a filter bag each time it is dumped.

In operation, the process for using the disclosed equipment in a mobile operation for stripe removal:

1. Connection valve remains closed. Water side is used only as a fresh water supply and is not placed under vacuum at any time.

2. Filter material positioned in the vacuum tank at a distance off the walls and floor of the tank. A filter "bag" may also be hung by hooks from the ceiling to produce even cleaner waste water.

3. The vacuum tank is placed under vacuum by starting the diesel powered vacuum pump which is connected by an air outlet hose to the vacuum tank.

4. As strip material is removed creating a slurry of water and debris, the mixture is drawn through the inlet hose into the vacuum tank being trapped in the filter.

5. When the vacuum tank reaches its full capacity, a shutoff ball is forced upwards toward the air outlet hose and makes contact with a ball seal causing loss of tank vacuum.

6. The drain valve is then opened on the vacuum tank. The drain permits water to drain through the filter material and into the open cavity between the walls and floor allowing an exit from the drain.

7. The shutoff valve is closed allowing for a capacity equal to the capacity previously occupied by dirty water, only the debris slurry remains inside the tank.

8. Steps 1-7 are repeated until the strip is removed.

9. Upon opening of a door to the vacuum container, allows for a removal of all debris captured in the filter.

The instant invention may also be used in a non-mobile setting in continuous operation as follows.

1. The connection valve remains open except when it is necessary to dump the water side. Water side is used as an overflow vacuum tank and is under vacuum much of the time.

2. Filter material positioned in the vacuum tank at a distance off the walls and floor of the tank. A filter "bag" may also be hung by hooks from the ceiling to produce even cleaner waste water.

3. Vacuum tank is placed under vacuum by starting the diesel powered vacuum pump which is connected by the air outlet hose to the vacuum tank. Water side is under vacuum as well by way of connection valve.

4. As strip material is removed creating a slurry of water and debris, the mixture is drawn through the inlet hose into the vacuum tank being trapped in the filter.

5. As the debris and water level rise to the level of the connection valve, the water will begin flowing through the connection valve into the water side. The water in the water side tank will be filtered water as the water has had to first flow through the filter material to reach the connection valve.

6. When the waste water has reached the level of the connection valve it will be visible to the operator through a strategically positioned sight glass. At that point, without shutting down the vacuum or the operation, the operator closes the connection valve which releases the water side tank from vacuum.

7. Next, the operator must open the drain valve on the water side to release the waste water being held there.

8. After the water tank has drained completely, the water side drain valve must be closed.

9. The connection valve is reopened allowing wastewater to flow freely into the water side box.

10. Repeating of steps 1-9 while never shutting down or affecting the blasting operation whatsoever. This may be continued until the vacuum tank is full of debris.

11. It is now necessary to shut off the vacuum power unit and open the drain valve on the vacuum tank. This allows the water to drain through the filter material, into the open cavity between the walls and floor, and exit the drain. This allows the debris to dewater.

12. Opening of the vacuum door allows for a release of all material to repeat the process.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

What is claimed is:

1. A process for removing material comprising the steps of:

1. providing a vacuum tank and a water tank with a connection valve therebetween, closing of said connection valve;
2. inserting a bag constructed from filter material completely within said vacuum tank said bag including an open top;
3. creating a vacuum in said vacuum tank by use of a vacuum pump powered by an internal combustion engine;
4. directing ultra high pressure water at a material to be removed creating a debris slurry, said slurry drawn into said vacuum tank and directed into from top of said open top of said filter bag whereby said debris being trapped in said filter bag;
5. stopping the creation of the vacuum when said vacuum tank reaches full capacity;
6. draining water, but not said debris from said vacuum tank through said filter material, said filter material retaining substantially all said debris; and
7. repeating steps 1-7 until said filter bag is filled.

2. The process for removing material of claim 1 wherein said open top of said filter bag is hung on hooks positioned within said vacuum tank.

3. The process for removing material of claim 2 wherein said hooks are secured to ceiling of said vacuum tank.

4. A process for removing material comprising the steps of:

1. providing a vacuum tank and a water tank with a connection valve there between, opening said connection valve;
2. inserting a bag constructed from filter material completely within said vacuum tank said bag including an open top;

3. creating a vacuum in said vacuum tank by use of a vacuum pump powered by an internal combustion engine;
4. directing ultra high pressure water at a material to be removed creating a debris slurry, said slurry drawn into said vacuum tank and directed into from top of said open top of said filter bag whereby said debris being trapped in said filter bag;
5. allowing water to pass from said vacuum tank through said connection valve to said water tank when the water level rises to the level of said connection valve;
6. closing of said connection valve releasing vacuum from said water side tank;
7. draining of water from said water tank;
8. closing drain valve;
9. opening said connection valve; and
10. repeating steps 1-9 until said filter material is filled.

5. The process for removing material of claim 4 wherein said open top of said filter bag is hung on hooks positioned within said vacuum tank.

6. The process for removing material of claim 5 wherein said hooks are secured to ceiling of said vacuum tank.

* * * * *